United States Patent [19]

Canter

[11] 4,058,473

[45] Nov. 15, 1977

[54] LOW TEMPERATURE STABLE COMPOSITIONS

[75] Inventor: Carl Robert Canter, Bloomfield, N.J.

[73] Assignee: Lever Brothers Company, New York, N.Y.

[21] Appl. No.: 699,727

[22] Filed: June 24, 1976

[51] Int. Cl.[2] ..... C11D 9/32

[52] U.S. Cl. ..... 252/121; 252/89 R; 252/117; 252/118; 252/122; 252/132; 252/DIG. 1; 252/DIG. 14

[58] Field of Search ..... 252/132, 121, 122, 117, 252/118, DIG. 1, DIG. 14, 108, 89

[56] References Cited

U.S. PATENT DOCUMENTS 3,931,033 1/1976 Löhr et al. ..... 252/122

3,985,670 10/1976 Berg et al. ..... 252/122 X

*Primary Examiner*—Mayer Weinblatt

*Attorney, Agent, or Firm*—James J. Farrell; Melvin H. Kurtz; Kenneth F. Dusyn

[57] ABSTRACT

Low temperature stable compositions are disclosed containing potassium tallowate and a combination of secondary ethoxylated alcohols containing (a) a blend of $C_{11-15}$ secondary alcohols with an average of 9 moles of ethylene oxide and (b) a blend of $C_{11-15}$ secondary alcohols with an average of 3 moles of ethylene oxide. These compositions stay liquid at 50° F and once frozen can be completely thawed by being placed at 50° F for a specified period of time. The temperature at which these compounds freeze is about 35° F.

1 Claim, No Drawings

LOW TEMPERATURE STABLE COMPOSITIONS

The instant invention relates generally to detergent composition which are stable at low temperatures.

Detergent compositions utilizing an anionic, nonionic and combinations of anionic and nonionic detergents are well known in the art (see of example U.S. Pat. No. 3,869,399). This patent deals with a concentrated heavy duty liquid detergent composition containing a mixture of nonionic surfactants together with an anionic surfactant combination. The anionic combination is a mixture of an ethanolamine salt of an alkylbenzene sulfonic acid and an ethanolamine salt of a fatty acid. The type of composition disclosed in this patent frequently becomes extremely viscous at low temperatures. Once such a composition is frozen relatively long periods of time are necessary to thaw it. Many detergents of necessity are shipped during cold weather. Frequently, these detergents are shipped in fiber drums which cannot withstand direct high temperature heating. Compositions shipped in this manner require days to thaw once frozen. Ideally, most of these detertgents should be stored at temperatures high enough to insure their fluidity during both shipment and storage. In practicality, however, it is often found that such compositions are shipped and stored at low temperatures which are at or below the freezing point of the compositions. Once the composition freezes or becomes gelatinous, it is not easily pourable and thus is almost impossible to utilize until fluidity is reestablished. Frequently, as stated above, depending on the composition and the temperature to which it can be heated a detergent may take 3 or 4 days to become completely fluid after freezing. Maintaining fluidity is especially important if large batches of detergent are shipped because of the difficulty of thawing large quantities of material. In addition, detergent solutions utilized must be sufficiently concentrated to facilitate practical commercial washing operations and the components of such compositions must also be adequate to properly clean materials to which they are applied. Thus, maintaining fluidity with a highly concentrated detergent formulation is difficult in cold weather. First, because of the high detergent active concentration the composition more easily gelatinizes or freezes. If a more dilute solution of detergent could be shipped, the freezing point would be lower, however, shipping large quantities of water is prohibitively expensive. Additionally, slected surfactants which provide good detergency are found to gelatinize readily. It is thus seen that a liquid detergent system which has good stability, which freezes at a relatively low temperature, and which is relatively easy to solubilize after freezing is extremely desirable.

It is therefore an object of the invention to provide a detergent with a relatively low freezing point.

Another object is to provide a detergent with a favorable freezing pattern, i.e. a product which freezes relatively uniformly at low temperatures enabling it to retain its uniformity during thawing.

Other objects and advantages will appear as the description proceeds.

The attainment of the above objects is made possible by this invention which includes an aqueous solution of potassium tallowate and a combination of two $C_{11-15}$ secondary ethoxylated alcohols, one of which has an average of 9 moles of ethylene oxide per mole of alcohol, the other having an average of 3 moles of ethylene oxide per mole of alcohol.

The subject invention overcomes one or more of the disadvantages of the prior art heretofore described. This is accomplished with the advantages that such a composition provides relatively stable behavior at temperatures down to to about 35° F and in addition, has a freezing pattern which freezes uniformly at this temperature and thus thaws more uniformly.

With these and other objects in mind, the invention is hereinafter set forth in detail, the novel features thereof being particularly pointed out in the appended claims.

Generally, the compositions of the present invention include a combination of about 5 to about 25% of a soap with a mixture of about 5 to about 30% of two ethoxylated secondary alcohols, the balance of the composition being water. In addition to the surfactant actives, about 1 to about 10% of a hydrotrope is generally employed. Frequently, adjuvants such as glycerine, fillers, chelating agents, pH adjusting agents and the like may also be used in minor amounts.

The preferred anionic surfactant is potassium tallowate which is a soap formed from potassium hydroxide and tallow oil or tallow fatty acids. An analysis of tallow fatty acids in the tallow oil shows that the acids contain an average of 16 to 18 carbon atoms. A typical fatty acid composition of tallow oil is as follows:

TABLE I

| | Percent |
|---|---|
| Myristic | 2.2 |
| Palmitic | 35.0 |
| Stearic | 15.7 |
| Oleic | 44.4 |
| Linoleic | 2.2 |
| Linolenic | 0.4 |
| Arachidonic | 0.1 |

The amount of potassium tallowate used with the invention varies from about 5 to about 20% by weight of the total composition, from about 8 to about 12% being preferred to insure good low temperature stability.

The preferred nonionic surfactants, as previously stated, are ethoxylated secondary alcohol. A combination of these nonionic surfactants is utilized. Both of the preferred secondary alcohols have an average chain length of about 11 to 15 carbon atoms. The first of these has an average of 9 ethylene oxide units per mole of alcohol and the second has an average of about 3 moles of ethylene oxide per mole of alcohol. The alcohol containing 9 moles of ethylene oxide is marketed under the tradename "Tergitol 15-S-9" by the Union Carbide Corporation. The alcohol containing 3 moles of ethylene oxide is marketed under the tradename "Tergitol 15-S-3" and is also marketed by Union Carbide Corporation. Both of these alcohols may be prepared according to the procedure fully described in U.S. Pat. No. 2,870,220. The amounts of these alcohols used varies depending on the number of moles of ethylene oxide. The alcohol containing 9 moles of ethylene oxide alcohol is used in an amount of from about 8 to about 20% by weight of the composition and preferably from about 8 to about 12% to insure good low temperature stability. The alcohol containing 3 moles of ethylene oxide is used in an amount of about 1 to about 3.5% of the composition and preferably to insure good low temperature stability about 2 to about 3.5% of the composition.

The hydrotrope utilized must be such as to solubilize the anionic and nonionic components when incorporated into a water solution. Any common hydrotroping agent may be utilized such as for example, sodium xylene sulfonate and sodium toluene sulfonate, sodium ethyl benzene sulfonate and sodium cumene sulfonate. In addition to these specific hydrotropes, mixtures of the hydrotropic agent can be used. Generally, the amount of hydrotrope used is from about 1 to 10% and preferably depending on the amount of the outer components utilized about 1.0% to about 3.5%. Particularly preferred is sodium xylene sulfonate and a mixture of sodium xylene sulfonate and sodium toluene sulfonate where the sodium toluene sulfonate is present in an amount of from about 0 to 25% of the sodium xylene sulfonate. When this particular mixture is utilized, it is preferably present in an amount of about 1.0 to 3.5%.

The compositions of the invention have a freezing range of about 35° F to 45° F. These compositions are stored for 1 week at 50° F and evaluated for stability. This evaluation is done by subjective testing and reported as stable or unstable depending on whether the composition was clear or cloudy, whether the composition was sufficiently fluid to pour, whether the components of the composition separated and also whether the components separated in an irreversible manner. The compositions of the invention as illustrated in Table II are found to be relatively stable after this 1 week storage test at 50° F.

The following Examples will more fully illustrate the embodiments of this invention. All parts, percentages and proportions referred to herein and in the appended claims are by weight unless otherwise indicated.

TABLE 2

| | COMPOSITIONS | | | | | | | |
|---|---|---|---|---|---|---|---|---|
| EXAMPLES | 1 | 2 | 3 | 4 | 5 | 6 | 7 | 8 |
| Potassium tallowate | 10.63 | 10.63 | 10.63 | 5.32 | 5.32 | 21.26 | 21.26 | 5.32 |
| Tergitol-S-9 | 10.53 | 10.53 | 10.53 | 5.27 | 21.06 | 5.27 | 10.53 | 21.06 |
| Tergitol S-3 | 3.50 | 3.50 | 1.75 | 1.75 | 7.00 | 3.50 | 3.50 | 3.50 |
| Sodium xylene sulfonate | 2.00 | 2.40 | 2.40 | 2.40 | 2.40 | 1.80 | 1.80 | 2.00 |
| Sodium toluene sulfonate | 0.40 | — | — | — | — | 0.60 | 0.60 | 0.40 |
| Glycerine | 1.05 | — | 1.05 | 1.05 | 1.05 | 1.05 | 1.05 | 1.05 |
| EDTA | 0.07 | — | 0.07 | 0.07 | 0.07 | 0.07 | 0.07 | 0.07 |
| KOH | 0.31 | — | 0.31 | 0.31 | 0.31 | 0.31 | 0.31 | 0.31 |
| Water | 70.98 | 72.94 | 69.70 | 83.47 | 62.43 | 65.78 | 70.52 | 63.93 |
| Adjuvants | 0.36 | — | 0.36 | 0.36 | 0.36 | 0.36 | 0.36 | 0.36 |

This invention has been described with respect to certain preferred embodiments and various modifications thereof will occur to persons skilled in the art in the light of the instant specification and are to be included within the spirit and purview of this application and the scope of the appended claims.

What is claimed is:

1. A low temperature, stable detergent composition consisting of:

| | Percent by Weight |
|---|---|
| Potassium tallowate | about 8% to about 12% |
| $C_{11-15}$ ethoxylated secondary alcohol having about 9 moles of ethylene oxide per mole of alcohol | about 8% to about 12% |
| $C_{11-15}$ ethoxylated secondary alcohol having about 3 moles of ethylene oxide per mole of alcohol | about 2% to about 4% |
| Sodium xylene sulfonate | about 1% to about 3% |
| Sodium toluene sulfonate | 0% to about .6% |
| Glycerine | about 0% to about 1.5% |
| EDTA | about 0% to about 0.1% |
| KOH | about 0% to about 0.5% |
| Adjuvants | 0% to about 0.36% |
| Water | at least 63.93% by weight of the composition up to 100% of the balance by weight. |

* * * * *

UNITED STATES PATENT AND TRADEMARK OFFICE

CERTIFICATE OF CORRECTION

PATENT NO. : 4,058,473

DATED : November 15, 1977

INVENTOR(S) : Carl Robert Canter

It is certified that error appears in the above-identified patent and that said Letters Patent are hereby corrected as shown below:

In the Specification:

Col. 3, Table 2: "Tergitol-S-9" should be -- Tergitol 15-S-9 --.

Col. 3, Table 2: "Tergitol S-3" should be -- Tergitol 15-S-3 --.

Signed and Sealed this

*Twenty-first* Day of *March 1978*

[SEAL]

*Attest:*

RUTH C. MASON
*Attesting Officer*

LUTRELLE F. PARKER
*Acting Commissioner of Patents and Trademarks*